US009069321B2

(12) United States Patent
Kwon et al.

(10) Patent No.: US 9,069,321 B2
(45) Date of Patent: Jun. 30, 2015

(54) WASTE CONTAINER AND ELECTROPHOTOGRAPHIC IMAGE FORMING APPARATUS INCLUDING THE SAME

(75) Inventors: Oh-deug Kwon, Suwon-si (KR); Myung-kook Ahn, Hwaseong-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 46 days.

(21) Appl. No.: 13/565,910

(22) Filed: Aug. 3, 2012

(65) Prior Publication Data

US 2013/0183050 A1 Jul. 18, 2013

(30) Foreign Application Priority Data

Jan. 18, 2012 (KR) ..... 10-2012-0005835

(51) Int. Cl.
*G03G 21/12* (2006.01)

(52) U.S. Cl.
CPC ..... *G03G 21/12* (2013.01)

(58) Field of Classification Search
CPC ..... G03G 21/105; G03G 2221/0052; G03G 2221/0057; G03G 2221/0063; G03G 2221/0685
See application file for complete search history.

(56) References Cited

U.S. PATENT DOCUMENTS 5,398,098 A * 3/1995 Fukunaga et al. ..... 399/110
2003/0059229 A1* 3/2003 Yamamoto et al. ..... 399/109
2011/0103845 A1* 5/2011 Sato ..... 399/263

FOREIGN PATENT DOCUMENTS

JP 2005292608 A * 10/2005 ..... G03G 21/10
JP 2005-345941 12/2005
JP 2008309987 A * 12/2008

OTHER PUBLICATIONS

JP 2005292608 Machine Translation.*
JP 2005292608 A Machine Translation.*
JP 2008309987 A Machine Translation.*

* cited by examiner

*Primary Examiner* — Clayton E Laballe
*Assistant Examiner* — Victor Verbitsky
(74) *Attorney, Agent, or Firm* — Staas & Halsey LLP

(57) ABSTRACT

A waste container is detachably mounted on an electrophotographic image forming apparatus to electrophotographically print an image by using a developing agent formed by mixing a carrier and a toner and receives therein a waste during the printing. The waste container includes a first inlet through which a first waste is introduced, a second inlet through which a second waste is introduced, a first region in which the first waste is stored, and a second region that is separated from the first region and in which the second waste is stored.

23 Claims, 11 Drawing Sheets

WASTE CONTAINER AND ELECTROPHOTOGRAPHIC IMAGE FORMING APPARATUS INCLUDING THE SAME

CROSS-REFERENCE TO RELATED APPLICATIONS

This application claims the benefit of priority under 35 U.S.C. §119 from Korean Patent Application No. 10-2012-0005835, filed on Jan. 18, 2012, in the Korean Intellectual Property Office, the disclosure of which is incorporated herein in its entirety by reference.

BACKGROUND OF THE INVENTION

1. Field of the Invention

The present general inventive concept relates to a waste container and an electrophotographic image forming apparatus including the same.

2. Description of the Related Art

An electrophotographic image forming apparatus forms an electrostatic latent image by emitting light corresponding to image information to a photosensitive body and forms a toner image by supplying a developing agent to the electrostatic latent image. The electrophotographic image forming apparatus prints an image on a recording medium by transferring the toner image to the recording medium and fixing the toner image to the recording medium by applying heat and pressure.

If a one-component developing method is used, a toner is used as the developing agent, and if a two-component developing method is used, a toner and a carrier are used as the developing agent. The carrier carries the toner and only the toner is developed on the photosensitive body in order to form the toner image.

As the electrophotographic image forming apparatus operates, a waste developing agent may be produced from the photosensitive body, an intermediate transfer medium, and a developer unit. The waste developing agent is delivered to and received in a waste developing agent receiver.

SUMMARY OF THE INVENTION

The present general inventive concept provides a waste container in which a waste developing agent may be effectively received and an electrophotographic image forming apparatus including the waste container.

Additional features and utilities of the present general inventive concept will be set forth in part in the description which follows and, in part, will be obvious from the description, or may be learned by practice of the general inventive concept.

According to features and utilities of the present general inventive concept, there is provided a waste container that is detachably mounted on an electrophotographic image forming apparatus for electrophotographically printing an image by using a developing agent formed by mixing a carrier and a toner and receives therein a waste discharged during the printing, the waste container including a first inlet through which a first waste is introduced, a second inlet through which a second waste is introduced, a first region in which the first waste is stored, and a second region that is separated from the first region and in which the second waste is stored.

The second inlet may be disposed below the first inlet.

The waste container may further include: a waste housing that includes the first region and the second region, and a barrier wall that is disposed in the waste housing and separates the second region from the first region. The barrier wall may be bonded to an interior of the waste housing.

The waste container may further include a distribution member that is disposed in the first region and distributes the first waste. The distribution member may include an auger that includes a rotational shaft and a spiral wing portion.

The waste container may further include a full sensing unit that detects whether the first region is full of the first waste. The full sensing unit may include an isolation chamber that is isolated from the first region and has an opening formed below the first inlet, and a sensor that is disposed in the isolation chamber and senses the first waste introduced through the opening. The waste container may further include a distribution member that is disposed below the first inlet of the first region and distributes the first waste, wherein the opening is formed below the distribution member.

The first waste may be a waste toner removed from a photosensitive body, and the second waste is a waste developing agent discharged from a developing unit for forming a toner image on the photosensitive body.

According to features and utilities of the present general inventive concept, there is provided an electrophotographic image forming apparatus including a printing unit that electrophotographically prints an image on a recording medium by using a developing agent formed by mixing a toner and a carrier, and a waste container that receives therein a waste discharged from the printing unit, wherein the waste container includes a first inlet through which a first waste is introduced, a second inlet through which a second waste is introduced, a first region in which the first waste is stored, and a second region that is separated from the first region and in which the second waste is stored, and the second inlet is disposed below the first inlet.

The printing unit may include a developing agent container in which the developing agent is received; a photosensitive body on which an electrostatic latent image is formed, a developing housing in which the developing agent supplied from the developing agent container is received, and a developing roller that is disposed in the developing housing and forms a toner image by supplying the toner to the electrostatic latent image, wherein the first waste is a waste toner removed from the photosensitive body, and the second waste is a waste developing agent discharged from the developing housing.

The developing agent container may be independently replaceable.

The printing unit may further include a waste toner discharging member that includes a waste toner outlet through which a waste toner removed from the photosensitive body is discharged, and a waste developing agent discharging member that includes a waste developing agent outlet through which a waste developing agent discarded from the developing housing is discharged, wherein when the waste container is mounted on the electrophotographic image forming apparatus, the waste toner discharging member is inserted into the first inlet and the waste developing agent outlet faces the second inlet. The waste developing agent outlet may be disposed over the second inlet, and the waste developing agent drops from the waste developing agent outlet through the second inlet into the second region.

The printing unit may further include an intermediate transfer medium to which the toner image is temporarily transferred, wherein the waste container further includes a third inlet through which a waste toner removed from the intermediate transfer medium is introduced. A waste toner introduced through the third inlet may be received in the first region.

According to features and utilities of the present general inventive concept, there is provided an electrophotographic image forming apparatus using a developing agent formed by mixing a toner and a carrier, the electrophotographic image forming apparatus including, a plurality of photosensitive bodies on which electrostatic latent images are formed, a plurality of developing agent containers that are individually replaceable and in which developing agents having different colors are contained, a plurality of developing units that form toner images by transferring the toner of each of the developing agents supplied from the developing agent containers to the electrostatic latent images, a waste toner discharging member that includes a waste toner outlet through which a waste toner removed from the plurality of photosensitive bodies is discharged, a waste developing agent discharging member that includes a waste developing agent outlet through which a waste developing agent discarded from the plurality of developing units is discharged and which is disposed below the waste toner outlet, and a detachable waste container that includes a first inlet corresponding to the waste toner outlet, a second inlet disposed below the first inlet to correspond to the waste developing agent outlet, a first region in which the waste toner is received, and a second region that is separated from the first region and in which the waste developing agent is received.

The electrophotographic image forming apparatus may further include a distribution member that is disposed below the first inlet in the first region and distributes a first waste.

The electrophotographic image forming apparatus may further include a full sensing unit that detects whether the first region is full of the waste toner, and includes an isolation chamber that is isolated from the first region and has an opening formed below the distribution member and a sensor that is disposed in the isolation chamber and senses the waste toner introduced through the opening.

The above and/or other features and utilities of the present general inventive concept may be achieved by providing a waste container to be detachably mounted on an electrophotographic image forming apparatus to electrophotographically print an image by using a developing agent formed by mixing a carrier and a toner and to receive therein a waste discharged during the printing, the waste container including a single housing having a first region formed with a first inlet to receive a first waste and a second region separated from the first region and formed with a second inlet to receive a second waste.

The first inlet may be disposed at a first distance from a bottom of the single housing, and the second inlet may be disposed at a second distance from the bottom of the single housing.

The image forming apparatus may include a plurality of developer units separately disposed to perform the printing, each developer unit having a first outlet to discharge a waste toner as the first waste and a second outlet to discharge a waste developing agent as the second waste, the first inlet may include a plurality of sub first inlets to be connected to the respective first outlets of the developer units, and the second inlets may include a plurality of sub second inlets to be connected to the respective second outlets of the developer units.

The image forming apparatus may include an apparatus housing installed with a plurality of developer units separately disposed to perform the printing, each developer unit having a first outlet to discharge a waste toner as the first waste and a second outlet to discharge a waste developing agent as the second waste, and the single housing may be disposed between the apparatus housing and the plurality of developer units to be connected to the first outlets and the second outlets of the respective developer units

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
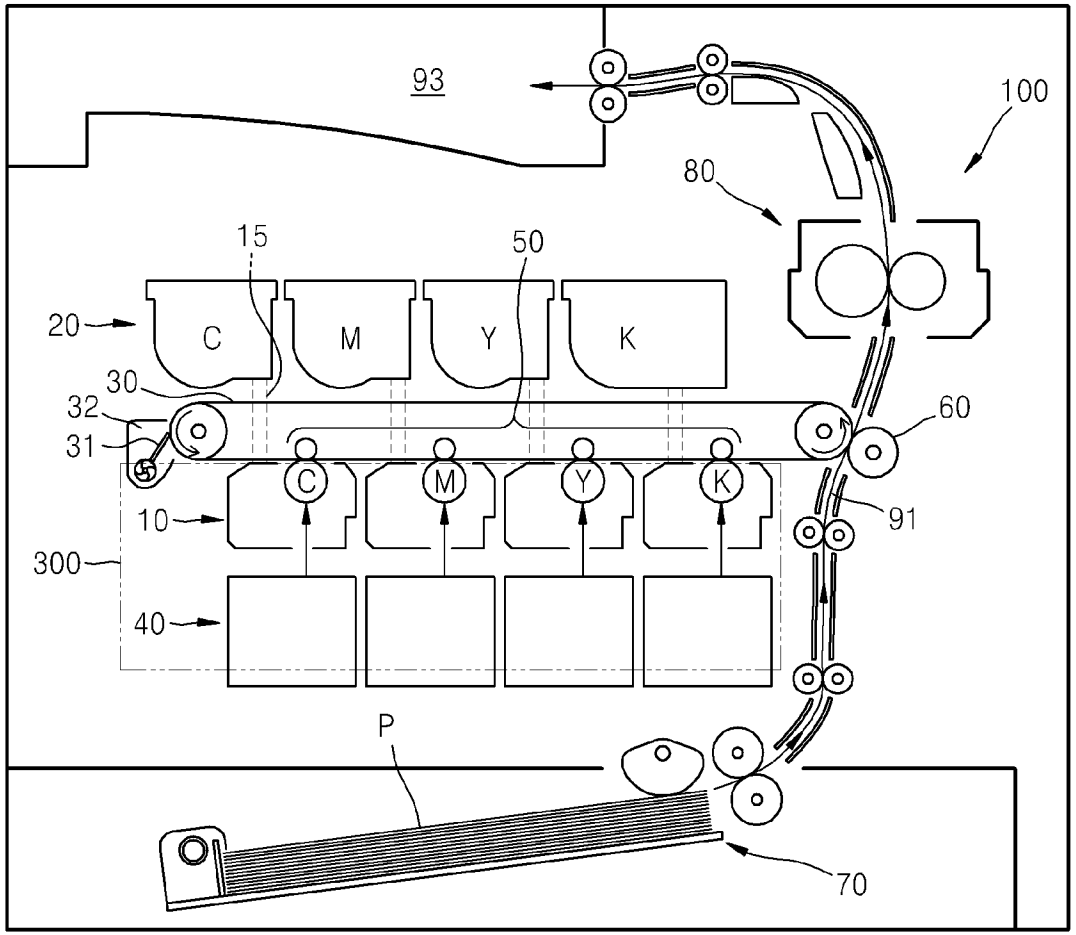
FIG. 1 is a side-sectional view illustrating an electrophotographic image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

FIG. 1 is a side-sectional view illustrating an electrophotographic image forming apparatus according to an embodiment of the present general inventive concept. The electrophotographic image forming apparatus of FIG. 1 is an electrophotographic color image forming apparatus that prints a color image by using cyan (C), magenta (M), yellow (Y), and black (K) developing agents (or developers) in an image forming operation (or printing operation) according to a control of a control unit (not illustrated) in an apparatus housing of the electrophotographic color image forming apparatus. Referring to FIG. 1, a printing unit 100 may include a developer unit 10, an exposure unit 40, an intermediate transfer belt 30, a transfer roller 60, and a fixing unit 80 to perform the image forming operation.

For color printing, the developer unit 10 may include a plurality of developers 10C, 10M, 10Y, and 10K to develop images with the respective C, M, Y, and K developing agents. However, the present embodiment is not limited thereto, and the developer unit 10 may further include developers to develop images with other various color developing agents such as light magenta and white developing agents. The electrophotographic image forming apparatus is an electrophotographic color image forming apparatus including the plurality of developers 10C, 10M, 10Y, and 10K to form a color image by using the C, M, Y, and K developing agents.

The exposure unit 40 forms an electrostatic latent image on a photosensitive body 101 by emitting light modulated to correspond to image information to the photosensitive body 101. The exposure unit 40 may include a laser scanning unit (LSU) using a laser diode as a light source to emit the light. The exposure unit 40 respectively emits four light beams modulated to correspond to C, M, Y, and K images to a plurality of the photosensitive bodies 101 of the developers 10C, 10M, 10Y, and 10K. The exposure unit 40 may include one exposure member to emit all of the four light beams, or four exposure members to respectively emit the four light beams. Alternatively, the exposure unit 40 may include two exposure members each to emit two light beams of the four light beams.

The intermediate transfer belt 30 is an intermediate transfer medium to which images developed on the photosensitive bodies 101 of the plurality of developers 10C, 10M, 10Y, and 10K are temporarily transferred. A plurality of intermediate transfer rollers 50 are disposed to face the photosensitive bodies 101 of the plurality of developers 10C, 10M, 10Y, and 10M through the intermediate transfer belt 30. An intermediate transfer bias voltage can be applied to the plurality of intermediate transfer rollers 50 to transfer the images developed on the photosensitive bodies 101 to the intermediate transfer belt 30. Instead of the intermediate transfer rollers 50, corona transfer members or pin-scorotron intermediate transfer members may be used to perform the transferring the developed images.

The transfer roller 60 is disposed to face the intermediate transfer belt 30. A transfer bias voltage can be applied to the transfer roller 60 to transfer the images of the intermediate transfer belt 30 to a recording medium P (e.g., paper).

The fixing unit 80 fixes the transferred images onto the recording medium P by applying heat and/or pressure. The fixing unit 80 is not limited to a shape illustrated in FIG. 1. Other shapes of the fixing unit 80 may be used to enable the fixing of the image on the recording medium P.

The electrophotographic image forming apparatus of FIG. 1 may include a developing agent container unit 20 in which a developing agent is received. The developing agent container unit 20 is connected to the plurality of developers 10C, 10M, 10Y, and 10K through a plurality of developing agent supply paths 15. The developing agent container unit 20 may include developing agent containers 20C, 20M, 20Y, and 20K in which the C, M, Y, and K developing agents are respectively received. Accordingly, the C, M, Y, and K developing agents received in the developing agent containers 20C, 20M, 20Y, and 20K of the developing agent container unit 20 are supplied to the plurality of developers 10C, 10M, 10Y, and 10K through the plurality of developing agent supply paths 15. Each of the developing agent container unit 20 and the developer unit 10 may be independently replaced with a new one.

In this configuration, the exposure unit 40 forms electrostatic latent images on the photosensitive bodies 101 by emitting a plurality of light beams modulated to correspond to color image information to the photosensitive bodies 101 of the plurality of developers 10C, 10M, 10Y, and 10K. Due to the C, M, Y, and K developing agents supplied from the plurality of developing agent containers 20C, 20M, 20Y, and 20K to the plurality of developers 10C, 10M, 10Y, and 10K, the electrostatic latent images on the photosensitive bodies 101 of the plurality of developers 10C, 10M, 10Y, and 10K are developed into visible images. The visible images are sequentially transferred to the intermediate transfer belt 30. The recording medium P stacked on a paper feeder 70 is fed through a paper feed path 91 into between the transfer roller 60 and the intermediate transfer belt 30. Due to a transfer bias voltage applied to the transfer roller 60, the images transferred to the intermediate transfer belt 30 are transferred to the recording medium P. When the recording medium P passes through the fixing unit 80, the images are fixed to the recording medium P due to heat and pressure. The recording medium P with the images fixed thereto is discharged to a discharge portion or tray of the image forming apparatus through a discharging member 93.

Although the images developed on the photosensitive bodies 101 are transferred to the intermediate transfer belt 30 and then are transferred to the recording medium P passing between the intermediate transfer belt 30 and the transfer roller 60 as illustrated in FIG. 1, the present embodiment is not limited thereto. The recording medium P may directly pass between the intermediate transfer belt 30 and the photosensitive bodies 101 and the developed images may be directly transferred to the recording medium P. In this case, the transfer roller 60 is not employed.

Figure 2:
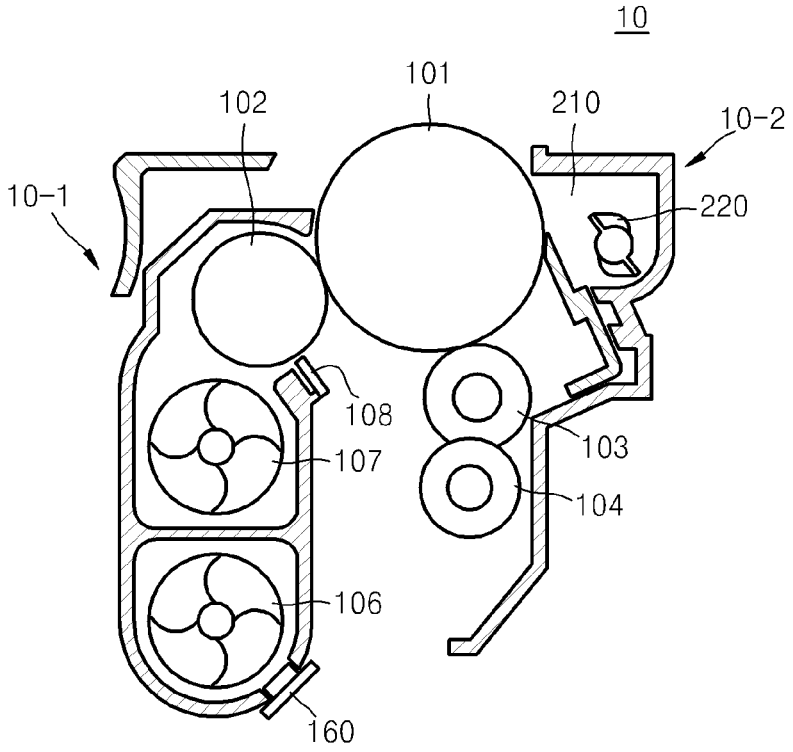
FIG. 2 is a side-sectional view illustrating a developer unit of the electrophotographic image forming apparatus of FIG. 1.

FIG. 2 is a side-sectional view illustrating the developer unit 10 of the electrophotographic image forming apparatus of FIG. 1. Referring to FIG. 2, the developer unit 10 may include a developing unit 10-1 including a developing roller 102, and a photosensitive unit 10-2 including the photosensitive body 101.

Although the photosensitive body 101 has a cylindrical shape on a surface of which a photosensitive layer is formed in FIG. 1, the present embodiment is not limited thereto. A charge roller 103 charges the photosensitive body 101 such that the photosensitive body 101 has a uniform surface potential. Instead of the charge roller 103, a charge brush or a corona charger may be used. A charge roller cleaner 104 removes a foreign substance such as dust or a developing agent attached to the charge roller 103. A cleaning blade 105 removes a toner remaining on the surface of the photosensitive body 101 after an image is transferred to the intermediate transfer belt 30. Instead of the cleaning blade 105, another type of photosensitive body cleaning device such as a rotating brush may be used. A waste toner removed from the photosensitive body 101 is received in a waste toner receiver 210.

The developing roller 102 supplies a developing agent in the developer unit 10 to the photosensitive body 101. A restriction member 108 restricts an amount of a developing agent supplied to a developing area where the photosensitive body 101 and the developing roller 102 are disposed to face each other through a developing area therebetween. The electrophotographic image forming apparatus of FIG. 1 uses a two-component developing method. The two-component developing method uses a toner and a carrier as a developing agent. The carrier may be, for example, a magnetic carrier. The developing roller 102 may be spaced apart from the photosensitive body 101 by a distance, for example, tens to hundreds of microns. Although not illustrated in FIG. 2, the developing roller 102 may include a magnetic roller, and may be configured such that the magnetic roller is disposed in a developing sleeve having a hollow cylindrical shape. The toner is mixed and stirred with the carrier in the developer unit 10 and then delivered to the developing roller 102. The toner is charged when being stirred with the carrier, and is attached to a surface of the carrier due to an electrostatic force. The carrier is attached to a surface of the developing roller 102 due to its magnetic force. As the developing roller 102 rotates, the toner attached to the carrier is delivered to the developing area where the photosensitive body 101 and the developing roller 102 face each other. Due to a developing bias voltage applied between the developing roller 102 and the photosensitive body 101, only the toner is supplied to the photosensitive body 101 to develop an electrostatic latent image formed on the surface of the photosensitive body 101 into a visible toner image.

In the two-component developing method, the carrier is received in the developer unit 10 and only the toner is supplied from the developing agent container unit 20 to the developer unit 10. The two-component developing method may degrade the performance of the carrier when the carrier is repeatedly used and also degrade the quality of an image. The electrophotographic image forming apparatus of FIG. 1 uses an auto developer refill (ADR) two-component developing method. In the ADR two-component developing method, a developing agent formed by mixing the toner and the carrier is received in the developing agent container unit 20 and the toner and the carrier are supplied to the developer unit 10. Since a portion of the carrier is discharged from the developer unit 10, it is necessary to supply a certain amount of a fresh (new) carrier to the developer unit 10, thereby preventing the performance of the carrier from being degraded and the quality of an image from being degraded.

Figure 3:
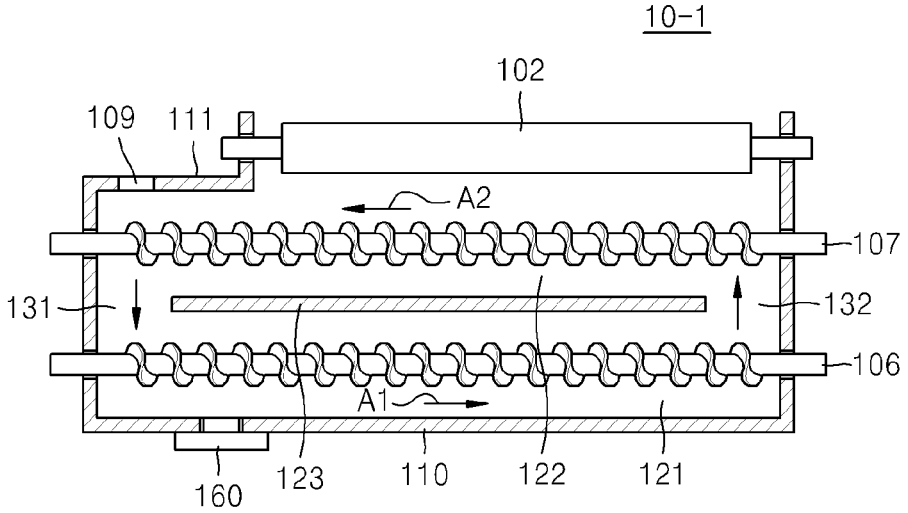
FIG. 3 is a cross-sectional view illustrating the developer unit of FIG. 2.

FIG. 3 is a cross-sectional view illustrating the developing unit 10-1 of the developer unit 10 of FIG. 2. Referring to FIGS. 2 and 3, the developing roller 102 is disposed in a developing housing 110 to expose a portion thereof to an outside of the developing housing 110. An inner space of the developing housing 110 is divided into first and second stir regions 121 and 122 by a barrier wall 123. The second stir region 122 may be disposed over the first stir region 121. First and second stirrers 106 and 107 are respectively disposed in the first and second stir regions 121 and 122. The first and second stirrers 106 and 107 may be augers to transport a developing agent in an axial direction. The first and second stirrers 106 and 107 are disposed parallel to the developing roller 102. The first and second stirrers 106 and 107 move a developing agent in opposite directions. For example, the first stirrer 106 moves a developing agent rightward in FIG. 3, that is, in an A1 direction, and the second stirrer 107 moves a developing agent leftward in FIG. 3, that is, in an A2 direction. First and second communication holes 131 and 132 are formed at lateral ends of the barrier wall 123 to communicate with the first and second stir regions 121 and 122

A toner density sensor 160 is disposed below the first stir region 121. The toner density sensor 106 detects a density of a toner in a developing agent in the developing housing 110. For example, the toner density sensor 160 may detect a density of at least one of the toner and the carrier by using an electrical characteristic thereof, for example, a magnetic force. That is, when a strength of a magnetic force detected by the toner density sensor 160 is high, it is determined that an amount of a toner in a developing agent is relatively small and an amount of a carrier is relatively large, and/or it is determined that a density of the toner may be low. When a strength of a magnetic force detected by the toner density sensor 160 is low, it is determined that an amount of a carrier is relatively small and an amount of a toner is relatively large, and/or it is determined that a density of the toner may be high. Alternatively, the toner density sensor 160 may detect a density of a toner in a developing agent by using a capacitance. A carrier and a toner have different dielectric constants. A capacitance varies according to a change in an amount of a toner in a developing agent existing between two counter electrodes. A density of the toner in the developing agent may be detected by using the change in the capacitance.

When a density of a toner detected by the toner density sensor 160 is lower than a predetermined reference density, the developing agent is supplied from the developing agent container unit 20 to the developing unit 10-1.

The developing housing 110 may have a portion 111 to be extended by a distance beyond a length of the developing roller 102. A developing agent inlet 109 to which an end portion of each of the developing agent supply paths 15 is connected is formed in the portion 111. A developing agent is supplied to the developing unit 10-1 from the developing agent container unit 20 through the developing agent supply path 15 and the developing agent inlet 109. The developing agent supplied into the developing housing 110 through the developing agent inlet 109 passes through the first communication hole 131 and drops into the first stir region 121. The developing agent circulates in the first stir region 121, the second communication hole 132, the second stir region 122, the first communication hole 131, and the first stir region 121 in an order listed above due to the first and second stirrers 106 and 107. When the developing agent passes through the second stir region 122, the developing agent is supplied to the developing roller 102.

A certain amount of the developing agent needs to be maintained in the developing housing 110. Also, a carrier in the developing housing 110 whose performance is degraded due to its repeated use needs to be discharged and a fresh carrier needs to be supplied into the developing housing 110. To this end, when it is determined from a density of a toner detected by the toner density sensor 160 that the density of the toner in the developing housing 110 is reduced, the electrophotographic image forming apparatus using the ADR two-component developing method supplies a new developing agent formed by mixing a carrier and a toner from the developing agent container unit 20 into the developing housing 110 and discharges a portion of a previously used developing agent in the developing housing 110 to the outside of the developing housing 110.

Figure 4:
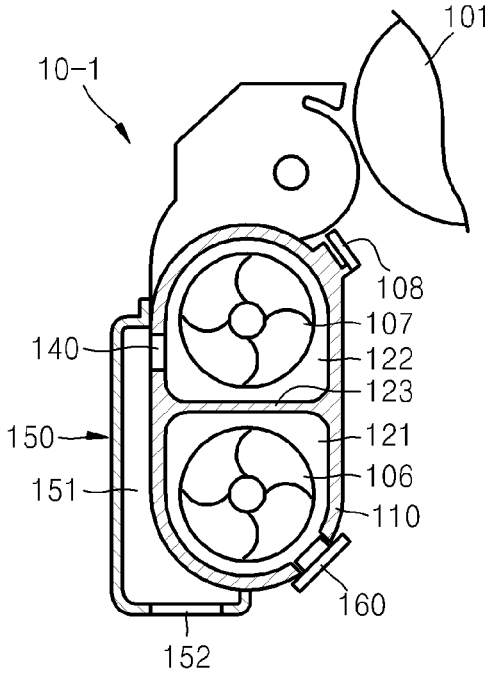
FIG. 4 is a side-sectional view illustrating a path through which a waste developing agent is discharged from a developing unit.
Figure 6:
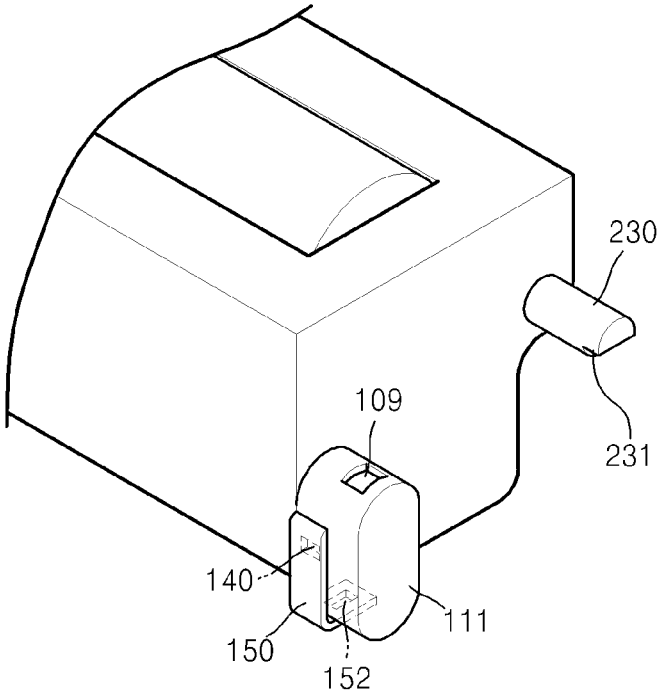
FIG. 6 is a partial perspective view illustrating the developer unit of FIG. 2.

Referring to FIGS. 3, 4, and 6, an outlet 140 through which a developing agent is discharged is formed in the portion 111 of the developing housing 110. The outlet 140 allows a developing agent to be discharged from the second stir region 122 therethrough. The outlet 140 is disposed at a downstream side with respect to a direction, for example, the direction A2, in which the second stirrer 107 moves a developing agent. The outlet 140 is disposed at an upstream side of the first communication hole 131 with respect to the direction in which a developing agent moves by the second stirrer 107 and/or in which the developing agent moves from the second stir region 122 to the first stir region 121. Accordingly, when a new developing agent is supplied from the developing agent container unit 20, the new developing agent is directly supplied through the first communication hole 131 to the first stir region 121. When an amount of a developing agent in the developing housing 110 is equal to or greater than an appropriate amount, an exceeded amount of the developing agent is discharged through the outlet 140 to the outside of the developing housing 110. That is, a developing agent passes through the second stir region 122 and is supplied to the developing roller 102, a toner is supplied from a developing area to the photosensitive body 101, and a portion of a carrier gathered in the second stir region 122 is discharged through the outlet 140 to the developing housing 110. In this case, a portion of the toner is also discharged. Hereinafter, a developing agent discharged from the developing housing 110 is referred to as a waste developing agent. Accordingly, before a developing agent passing through the second stir region 122 is supplied again through the first communication hole 131 to the first stir region 121, a portion of the developing agent may be discharged through the outlet 140. The outlet 140 may be formed on a side of the portion 111 of the developing housing 110. The outlet 140 and the developing agent inlet 109 may be formed on the portion of the developing housing 110.

A waste developing agent drops down due to its own weight through a discharge path 151 extending downward along a side wall of the developing housing 110. A waste developing agent discharging member 150 is disposed at the portion 111 of the developing housing 110 to form the discharge path 151. A waste developing agent outlet 152 is disposed at a bottom of the waste developing agent discharging member 150 to communicate with the discharge path 151. The waste developing agent discharged from the developing housing 110 passes through the discharge path 151 and then is discharged to the outside through the waste developing agent outlet 152.

Although not illustrated in FIG. 4, a shutter mechanism may be disposed in the waste developing agent outlet 152 to selectively open and close the waste developing agent outlet 152. The shutter mechanism may open the waste developing outlet 152 when a waste container 300 (see FIG. 1) and the waste developing agent outlet 152 are coupled (attached) to each other and may close the waste developing outlet 152 when the waste container 300 is removed (detached) from the electrophotographic image forming apparatus.

Figure 5:
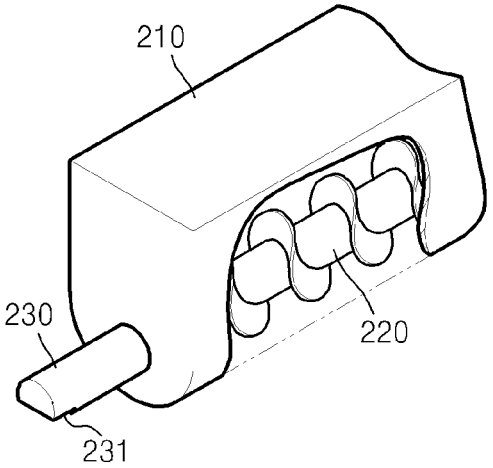
FIG. 5 is a perspective view illustrating a path through which a waste toner removed from a photosensitive body is discharged.

As described above, a waste toner remaining on the photosensitive body 101 after being transferred to the intermediate transfer belt 30 is removed by a cleaning blade 105 as illustrated in FIG. 2. Referring to FIGS. 2, 5, and 6, the removed waste toner is received in the waste toner receiver 210 disposed in the photosensitive unit 10-2. A waste toner feeding member 220 is disposed in the waste toner receiver 210 to feed the waste toner in a horizontal direction, that is, in a longitudinal direction of the photosensitive body 101. The waste toner feeding member 220 may be, for example, an auger to transport the waster toner in an axial direction. A waste toner discharging member 230 may extend from a side wall of the waste toner receiver 210. The waste toner in the waste toner receiver 210 is fed to the waste toner discharging member 230 by the waste toner feeding member 220. A waste toner outlet 231 is formed in an end portion of the waste toner discharging member 230.

Although not illustrated in FIGS. 5 and 6, a shutter mechanism may be disposed in the waste toner outlet 231 to selectively open or close the waste toner outlet 231. The shutter mechanism may open the waste toner outlet 231 when the waste container 300 (see FIG. 1) and the waste toner outlet 231 are coupled to each other and may close the waste toner outlet 231 when the waste container 300 is removed from the electrophotographic image forming apparatus.

Figure 7:
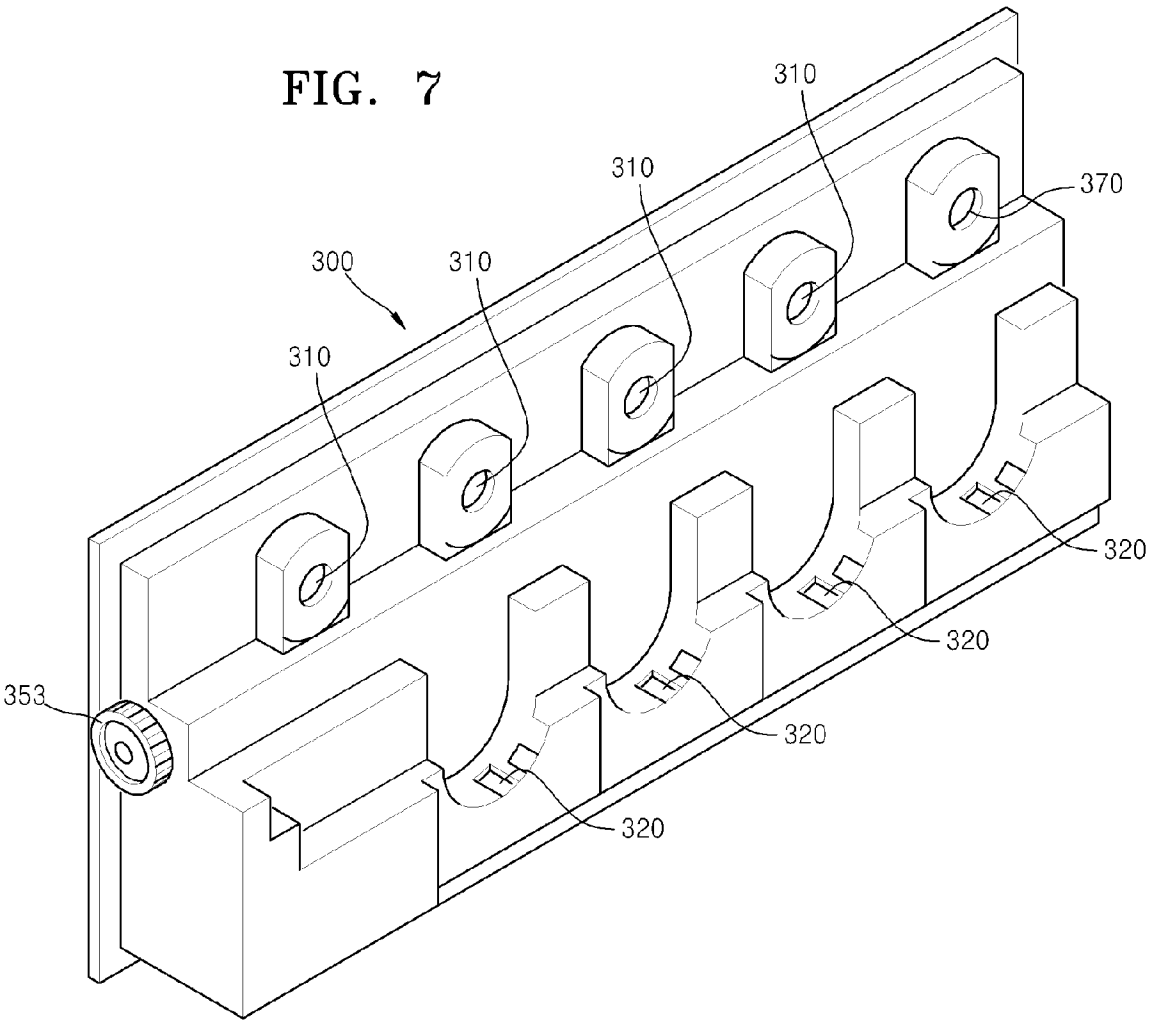
FIG. 7 is a perspective view illustrating a waste container according to an embodiment of the present general inventive concept.

Referring to FIG. 1, the electrophotographic image forming apparatus includes the waste container 300 to receive a waste developing agent (a second waste) discarded from the developing unit 10-1 and a waste toner (a first waste) removed from the photosensitive body 101. FIG. 7 is a perspective view illustrating the waste container 300 of the electrophotographic image forming apparatus of FIG. 1. Referring to FIG. 7, the waste container 300 may be a single housing and may include a first inlet 310 through which a waste toner removed from the photosensitive body 101 is introduced and a second inlet 320 through which a waste developing agent discharged from the developing unit 10-1 is introduced. Referring to FIG. 6, the waste developing agent outlet 152 is disposed below the waste toner outlet 231. Accordingly, the second inlet 320 is disposed below the first inlet 310. The waste container 300 includes a plurality of the first inlets 310 and the second inlets 320 to correspond to the plurality of developers 10C, 10M, 10Y, and 10K.

The waste container 300 is coupled to the electrophotographic image forming apparatus in a width direction of the developer unit 10, that is, in a longitudinal direction of the developing roller 102. In this case, the waste toner discharging member 230 may be inserted into the first inlet 310, and the waste toner discharged through the waste toner outlet 231 may be introduced into the waste container 300. Also, the waste developing outlet 152 may be disposed over the second inlet 320, and the waste developing agent may drop into the second inlet 320 and may be introduced into the waste container 300.

Figure 8:
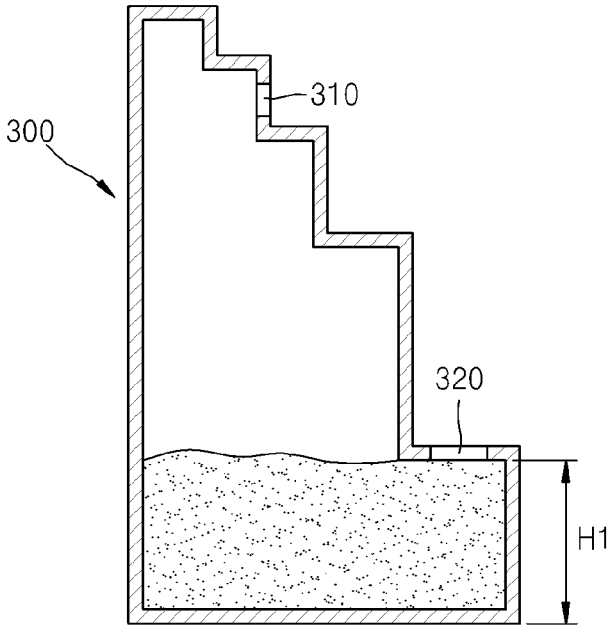
FIG. 8 is a side-sectional view illustrating a storage space of the waste container of FIG. 7.

As described above, the second inlet 320 is disposed below the first inlet 310 with respect to the waste container 300. If an inner space of the waste container 300 includes one region as illustrated in FIG. 8, a height at which a waste developing agent and a waste toner may be stored is limited to a height H1 of the second inlet 320. That is, a space having a height equal to or lower than the height H1 of the second inlet 320 may be used as an effective storage space, and a space having a height higher than the height H1 of the second inlet 320 may not be used as an effective storage space. When the waste toner and the waste developing agent are stored at a height higher than the height H1 of the second inlet 320, the waste toner and the waste developing agent may leak out of the waste container 300.

Figure 9:
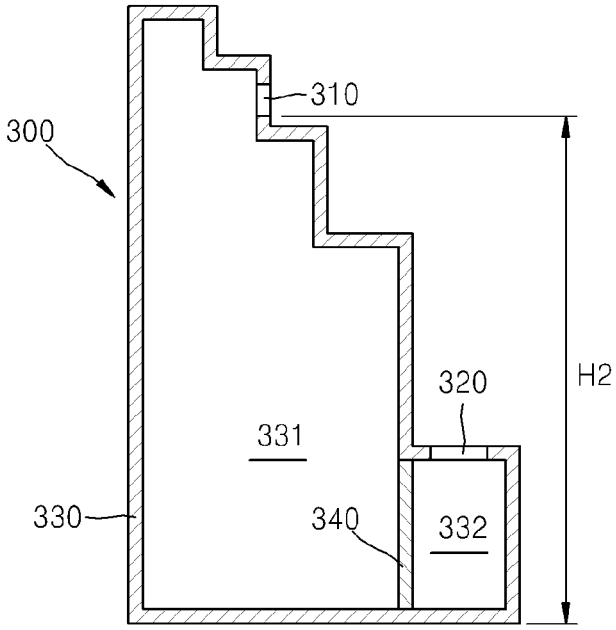
FIG. 9 is a side-sectional view illustrating the waste container of FIG. 7.
Figure 10:
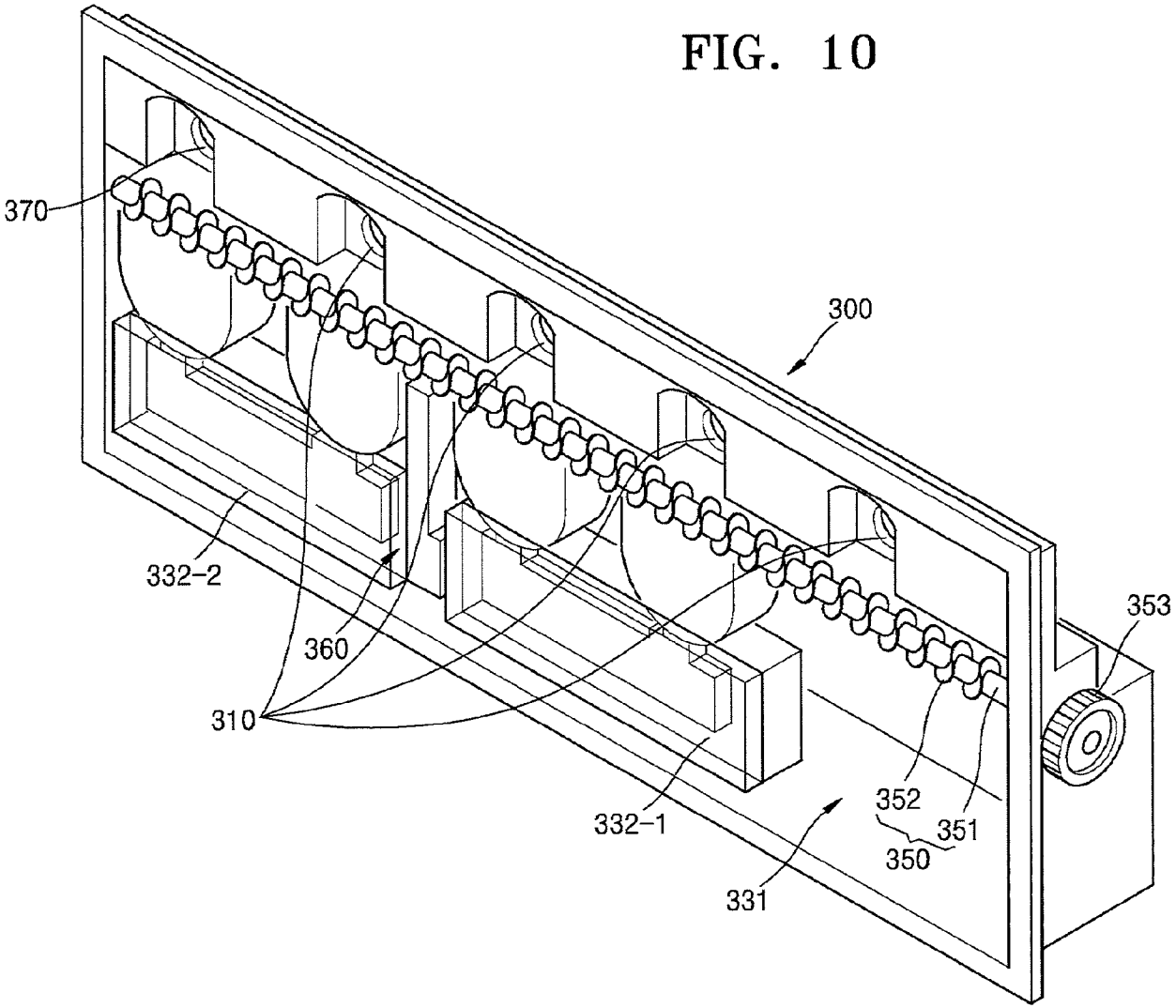
FIG. 10 is a perspective view illustrating an interior of the waste container of FIG. 7.

An inner space of the waste container 300 may be divided into two regions. Referring to FIGS. 9 and 10, the inner space of the waste container 300 is divided into a first region 331 in which a waste toner introduced through the first inlet 310 is stored and a second region 332 in which a waste developing agent introduced through the second inlet 320 is stored. The first region 331 and the second region 332 may be separated from each other by a barrier wall 340. For example, the barrier wall 340 may be formed by coupling a blocking member formed of a film or a plastic material to an interior of a waste housing 330 that includes the first and second regions 331 and 332 by using a bonding or fastening member. For example, the second region 332 may protrude from the first region 331 and the barrier wall 340 may be disposed at a boundary between the first and second regions 331 and 332. The second regions 332 may include two sub-regions 332-1 and 332-2 that are separated from the first region 331 and correspond to two second inlets 320, respectively. However, the present embodiment is not limited thereto, and four sub-regions may be provided to correspond to four first inlets 310, respectively.

As described above, since the first and second regions 331 and 332 are separated from each other and a space of the first region 331 having a height equal to a height H2 of the first inlet 310 may be used as an effective storage space, the storage efficiency of the waste container 300 may be improved. The waste container 300 is an expendable product that is replaced when the storage space is full. Since the storage efficiency of the storage space of the waste container 300 is improved, a life cycle of the waste container 300 is extended, thereby reducing expendable product costs.

Referring to FIG. 10, the waste container 300 may further include a distribution member 350 that distributes a waste toner. The distribution member 350 may be disposed in the first region 331. A waste toner introduced through the first inlet 310 into the first region 331 drops due to its weight and most of the waste toner may be stored right under the first inlet 310. The distribution member 350 uniformly distributes the waste toner stored right under the first inlet 310 to an inner space of the first region 331. The distribution member 350 may be disposed below the first inlet 310. For example, the distribution member 350 may be an auger including a rotational shaft 351 and a spiral wing portion 352. An end of the rotational shaft 351 extends to the outside of the waste container 300. A gear 353 (FIGS. 7 and 10) which is a power transmitting mechanism may be coupled to the end of the rotational shaft 351. When the waste container 300 is mounted on the electrophotographic image forming apparatus, the gear 353 may be connected to a driving unit (not illustrated) in the electrophotographic image forming apparatus to drive the distribution member 350. The driving unit may be used to drive at least one of structures of the image forming apparatus to perform the image forming operation as described above.

Figure 11:
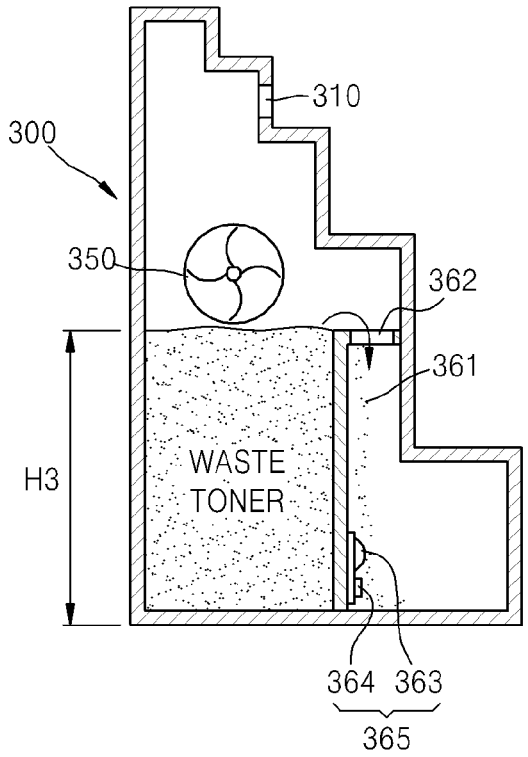
FIG. 11 is a side-sectional view illustrating a full sensing unit.

Referring to FIGS. 10 and 11, a full sensing unit 360 may be provided in the waste container 300. The full sensing unit 360 may be disposed in the first region 331. That is, the full sensing unit 360 may detect whether the first region 331 is full. The full sensing unit 360 may include an isolation chamber 361 isolated from the first region 331. A waste toner inlet 362 is formed in a top plate of the isolation chamber 361. When a waste toner introduced through the first inlet 310 is stored in the first region 331 to a height equal to or greater than a height H3 of the waste toner inlet 362, the waste toner is introduced through the waste toner inlet 362 to the isolation chamber 361. A waste toner sensor 365 is disposed in the isolation chamber 361. For example, the waste toner sensor 365 may be an optical sensor including a light emitter 363 and a light receiver 364. Light emitted by the light emitter 363 is reflected by the isolation chamber 361 to the light receiver 364. When a waste toner is received at a height equal to or greater than the height H3 in the first region 331, the waste toner is introduced through the waste toner inlet 362 to the isolation chamber 361 and is stored in the isolation chamber 361. Then, a portion of light is blocked by the waste toner and an amount of light incident on the light receiver 364 is reduced. When the amount of the light detected by the light receiver 364 is reduced to a level equal to or lower than a predetermined amount, it may be determined that the first region 331 is full. In this case, the control unit may generate a warning notice according to the determination such that a user can be informed of the warning notice that the waste container 300 needs to be replaced. The warning notice may be issued by acoustically sending a warning signal, visually blinking a warning light, or acoustically and visually displaying a message indicating that the waste container 300 needs to be replaced on a display device such as a display unit provided on the electrophotographic image forming apparatus.

Figure 12:
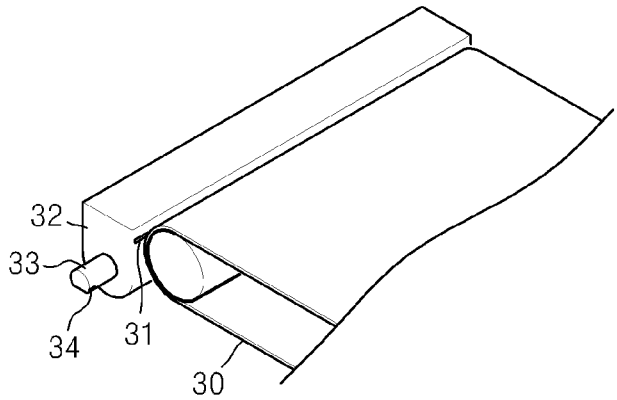
FIG. 12 is a partial perspective view illustrating a path through which a waste toner removed from an intermediate transfer belt is discharged.

A waste toner may be produced from the intermediate transfer belt 30. Referring to FIGS. 1 and 12, a toner is transferred to the recording medium P, however, a toner remaining on the intermediate transfer belt 30 is removed by a cleaning member 31 and is received in a second waste toner receiver 32. The waste toner is also discharged to the waste container 300. To this end, a waste toner feeding member (not illustrated) may be disposed in the second waste toner receiver 32 to feed a waste toner in a horizontal direction, that is, in a width direction of the intermediate transfer belt 30. The waste toner may be fed to a second waste toner discharging member 33 protruding from a side portion of the second waste toner receiver 32, and may be discharged through a second waste toner outlet 34 formed in the second waste toner discharging member 33.

Referring to FIG. 7, a third inlet 370 may be formed in the waste container 300. For example, when the waste container 300 is mounted on the electrophotographic image forming apparatus, the second waste toner discharging member 33 may be inserted into the third inlet 370 and thus a waste toner may be introduced from the second waste toner receiver 32 to the waste container 300. The third inlet 370 may communicate with the first region 331 and a waste toner removed from the intermediate transfer belt 30 may be received in the first region 331. Although not illustrated in FIG. 7, a connecting member may be further provided to connect the second waste toner outlet 34 and the third inlet 370.

Figure 13:
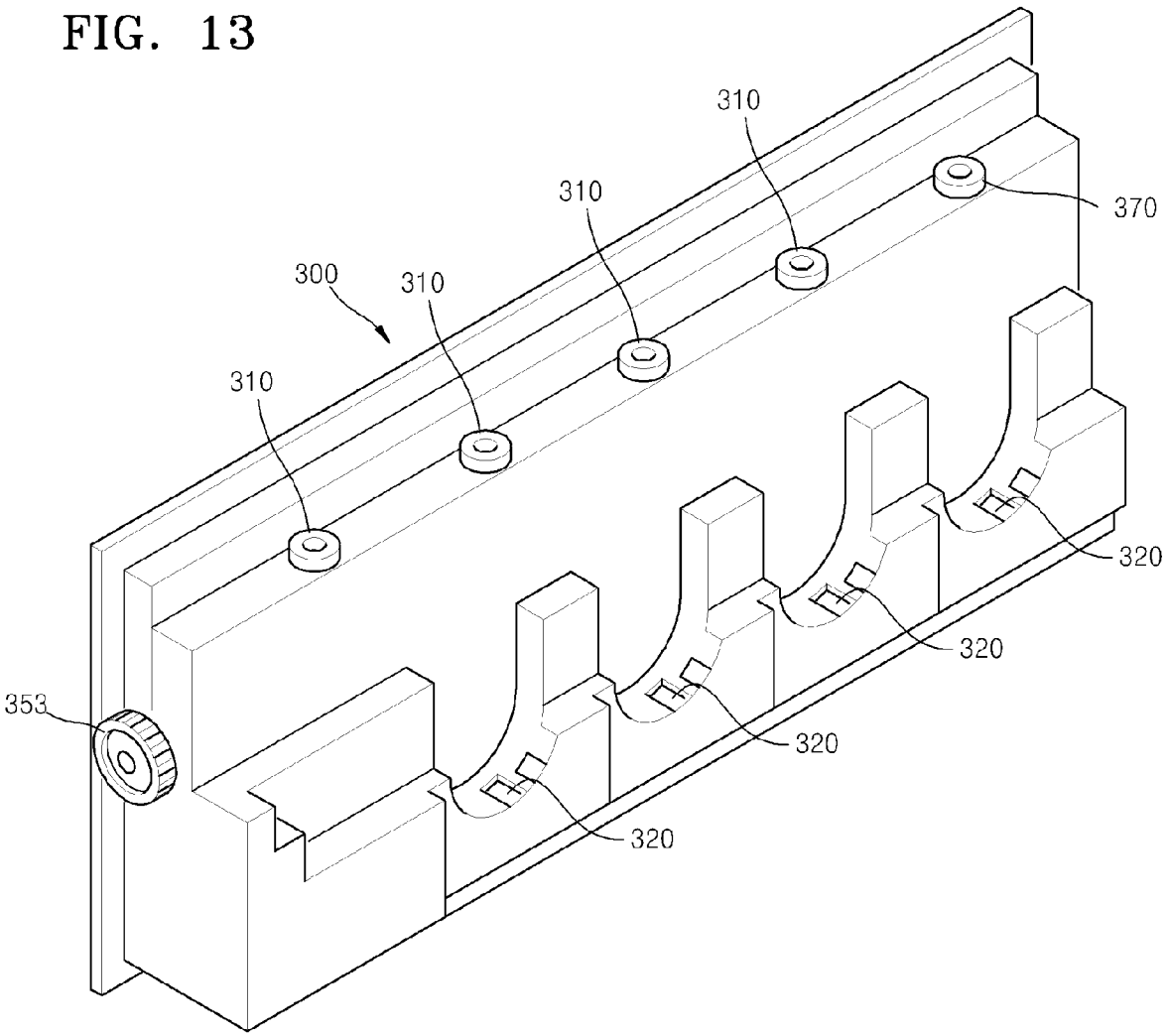
FIG. 13 is a view illustrating a waste container according to an embodiment of the present general inventive concept.

FIG. 13 is a view illustrating a waste container 300 according to an embodiment of the present general inventive concept. Referring to FIGS. 1 and 13, the first inlets 310 and the second inlets 320 are disposed to directly face the respective outlets 231 and 152 in the same direction. For example, openings of the first inlets 310 and the second inlets 320 are disposed in an upward direction to face openings of the outlets 231 and 152, for example. In this case, at least a portion of the toner discharging member 230 is disposed downward from a housing of the waste toner receiver 210 such that the waste toner outlet 231 can be coupled to the first inlet 310 of the waste container 300 when a single housing of the waste container 300 is coupled to the developer unit 10 in apparatus housing of the image forming apparatus. It is possible that the waste container 300 may be coupled to the developer unit 10 in a direction from a bottom to a top of the image forming apparatus. The housing of the image forming apparatus may have a structure to enable the coupling and decoupling of the waste container therewithin and therefrom and to support the waste container with respect to the developer unit 10. The third inlet 370 may be also disposed to directly face the outlet 34 in the same direction. Although the first inlets 310 and the third inlet 370 are disposed on a same plane in a direction where the developer units 10 are arranged, it is possible that the third inlet 370 is disposed on a different plane from a plane one which the first inlets 310 are disposed.

Figure 14:
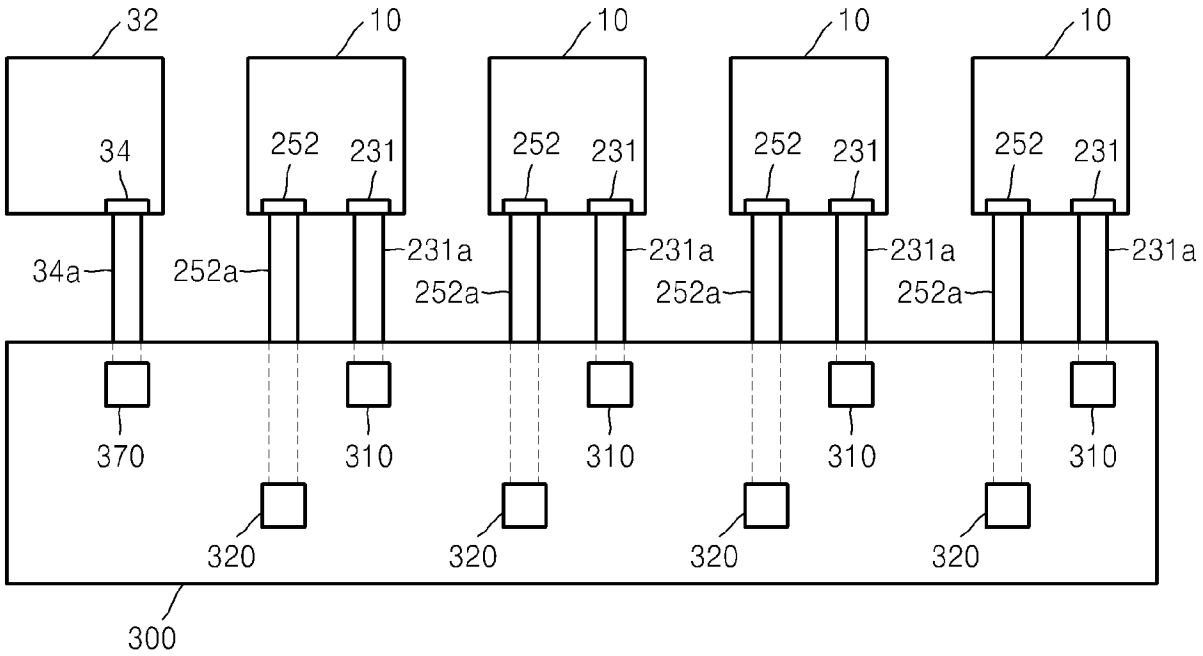
FIGS. 14 and 15 are diagrams illustrating a printing unit and a waste container according to embodiments of the present general inventive concept.

FIG. 14 is a diagram illustrating a waste container 300 according to an embodiment of the present general inventive concept. Referring to FIGS. 1 and 14, the developing unit 10 of the printing unit 100 may be connected to the waste container 300 through a first connector 231*a* and a second connector 252*a* to provide a waste toner path and a waste developing agent path, respectively. The second waste toner receiver 32 may be connected to the waste container 300 through a third connector 34*a* to provide a second waste toner path. The first connector 231*a* and the second connector 252*a* may be different in length. However, it is possible the first connector 231*a* and 252*a* may be same in length when the outlets 231 and 252 are disposed on different positions with respect to positions of the first inlet 310 and the second inlet 320.

Figure 15:
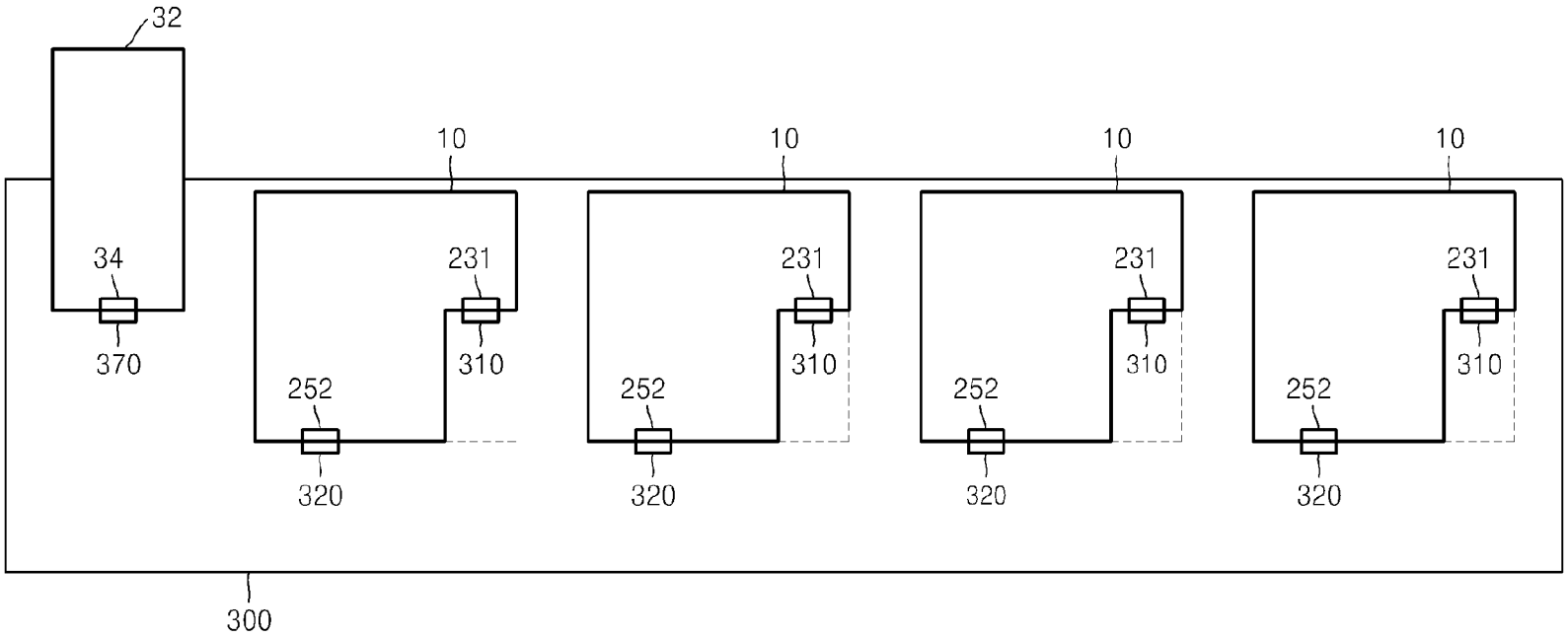

Referring to FIGS. 1 and 15, the developing unit 10 of the printing unit 100 may be directly connected to the waste container 300 without a connector such that a waste toner and a waste developing agent can be directly entered to the waste container 300 from the respective developer unit 10. The second waste toner receiver 32 may also be directly connected to the waste container 300 without a connector such that a waste toner can be directly entered to the waste container 300 from the second waste toner receiver 32. However, it is possible that one of the developer unit 10 and/or the second waste toner receiver 32 may be connected to the waste container through a connector when an outlet of the developer unit 10 and the second waste toner receiver 32 is disposed on a different position level (plane) or when at least one of the outlets of the developer unit 10 and the second waster toner receiver 32 is disposed on a different position level (plane). It is also possible that the first inlets 310 and the second inlets 320 are disposed to face the respective outlets such that the waste toner or waste developing agent can be directly transmitted to the waste container 300. It is also possible that the third inlet 370 is disposed to face the second waste toner outlet 34 to directly receive the second waste toner from the second waste toner receiver 32.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A waste container that is detachably mounted on an electrophotographic image forming apparatus to electrophotographically print an image by using a developing agent formed by mixing a carrier and a toner and receives therein a waste discharged during the printing, the waste container comprising:

a first inlet to receive a first waste;

a second inlet to receive a second waste;

a first region to receive the first waste introduced through the first inlet; and a second region to receive the second waste introduced through the second inlet, the second region being disposed within the first region and separated from the first region, wherein a bottom surface of the second region is at the same level as a bottom surface of the first region, wherein the second inlet is disposed below the first inlet, wherein the waste container further comprises a full sensing unit to detect whether the first region is full of the first waste, and wherein the full sensing unit comprises:

an isolation chamber inside the first region, the isolation chamber having an opening formed below the first inlet and being in communication with the first region, the isolation chamber being isolated from the second region and the second inlet; and a sensor disposed in the isolation chamber to sense the first waste introduced through the opening.

2. The waste container of claim 1, further comprising:

a waste housing formed with the first region and the second region; and a barrier wall disposed in the waste housing to separate the second region from the first region.

3. The waste container of claim 2, wherein the barrier wall is bonded to an interior of the waste housing.

4. The waste container of claim 1, further comprising:

a distribution member disposed in the first region to distribute the first waste.

5. The waste container of claim 4, wherein the distribution member comprises an auger having a rotational shaft and a spiral wing portion to transport the first waste.

6. The waste container of claim 1, further comprising:

a distribution member disposed below the first inlet of the first region to distribute the first waste, wherein the opening is formed below the distribution member.

7. The waste container of claim 1, wherein the first waste is a waste toner removed from a photosensitive body, and the second waste is a waste developing agent discharged from a developing unit to form a toner image on the photosensitive body.

8. An electrophotographic image forming apparatus comprising:

a printing unit to electrophotographically print an image on a recording medium by using a developing agent formed by mixing a toner and a carrier; and the waste container of claim 1 to receive therein a waste discharged from the printing unit.

9. The electrophotographic image forming apparatus of claim 8, further comprising:

a waste housing formed with the first region and the second region; and a barrier wall disposed in the waste housing to separate the second region from the first region.

10. The electrophotographic image forming apparatus of claim 9, further comprising:

a distribution member disposed in the first region to distribute the first waste.

11. The electrophotographic image forming apparatus of claim 8, further comprising:

a distribution member disposed below the first inlet of the first region to distribute the first waste, wherein the opening is formed below the distribution member.

12. The electrophotographic image forming apparatus of claim 8, wherein:

the printing unit comprises:

a developing agent container to receive the developing agent, a photosensitive body to be formed with an electrostatic latent image, a developing housing to receive the developing agent supplied from the developing agent container, and a developing roller disposed in the developing housing to form a toner image by supplying the toner to the electrostatic latent image; and the first waste is a waste toner removed from the photosensitive body, and the second waste is a waste developing agent discharged from the developing housing.

13. The electrophotographic image forming apparatus of claim 8, wherein the developing agent container is independently replaceable.

14. The electrophotographic image forming apparatus of claim 8, wherein:

the printing unit further comprises:

a waste toner discharging member having a waste toner outlet through which a waste toner removed from the photosensitive body is discharged, and a waste developing agent discharging member having a waste developing agent outlet through which a waste developing agent discarded from the developing housing is discharged; and when the waste container is mounted on the electrophotographic image forming apparatus, the waste toner discharging member is inserted into the first inlet and the waste developing agent outlet faces the second inlet.

15. The electrophotographic image forming apparatus of claim 14, wherein the waste developing agent outlet is disposed over the second inlet, and the waste developing agent drops from the waste developing agent outlet through the second inlet into the second region.

16. The electrophotographic image forming apparatus of claim 8, wherein:

the printing unit includes an intermediate transfer medium to which the toner image is temporarily transferred; and the waste container includes a third inlet through which a waste toner removed from the intermediate transfer medium is introduced.

17. The electrophotographic image forming apparatus of claim 16, wherein a waste toner introduced through the third inlet is received in the first region.

18. An electrophotographic image forming apparatus using a developing agent formed by mixing a toner and a carrier, the electrophotographic image forming apparatus comprising:

a plurality of photosensitive bodies on which electrostatic latent images are formed;

a plurality of developing agent containers to be individually replaceable and to contain developing agents having different colors;

a plurality of developing units to form toner images by transferring the toner of each of the developing agents supplied from the developing agent containers to the electrostatic latent images;

a waste toner discharging member having a waste toner outlet through which a waste toner removed from the plurality of photosensitive bodies is discharged;

a waste developing agent discharging member having a waste developing agent outlet through which a waste developing agent discarded from the plurality of developing units is discharged, and disposed below the waste toner outlet; and a detachable waste container having a first inlet corresponding to the waste toner outlet, a second inlet disposed below the first inlet to correspond to the waste developing agent outlet, a first region to receive the waste toner, and a second region to receive the waste developing agent, the second region being disposed within the first region and separated from the first region, wherein a bottom surface of the second region is at the same level as a bottom surface of the first region, wherein the second inlet is disposed below the first inlet, wherein the waste container further comprises a full sensing unit to detect whether the first region is full of the first waste, and wherein the full sensing unit comprises:

an isolation chamber inside the first region, the isolation chamber having an opening formed below the first inlet and being in communication with the first region, the isolation chamber being isolated from the second region and the second inlet; and a sensor disposed in the isolation chamber to sense the first waste introduced through the opening.

19. The electrophotographic image forming apparatus of claim 18, further comprising:

a distribution member disposed below the first inlet in the first region to distribute a first waste.

20. A waste container to be detachably mounted on an electrophotographic image forming apparatus to electrophotographically print an image by using a developing agent formed by mixing a carrier and a toner and to receive therein a waste discharged during the printing, the waste container comprising:

a single housing having a first region formed with a first inlet to receive a first waste and a second region formed with a second inlet to receive a second waste, the second region being disposed within the first region and separated from the first region, wherein a bottom surface of the second region is at the same level as a bottom surface of the first region, wherein the second inlet is disposed below the first inlet, wherein the waste container further comprises a full sensing unit to detect whether the first region is full of the first waste, and wherein the full sensing unit comprises:

an isolation chamber inside the first region, the isolation chamber having an opening formed below the first inlet and being in communication with the first region, the isolation chamber being isolated from the second region and the second inlet; and a sensor disposed in the isolation chamber to sense the first waste introduced through the opening.

21. The waste container of claim 20, wherein:

the first inlet is disposed at a first distance from a bottom of the single housing; and the second inlet is disposed at a second distance from the bottom of the single housing.

22. The waste container of claim 20, wherein:

the image forming apparatus comprises a plurality of developer units separately disposed to perform the printing, each developer unit having a first outlet to discharge a waste toner as the first waste and a second outlet to discharge a waste developing agent as the second waste;

the first inlet comprises a plurality of first inlets to be connected to the respective first outlets of the developer units; and the second inlet comprises a plurality of second inlets to be connected to the respective second outlets of the developer units.

23. The waste container of claim 20, wherein:

the image forming apparatus includes an apparatus housing installed with a plurality of developer units separately disposed to perform the printing, each developer unit having a first outlet to discharge a waste toner as the first waste and a second outlet to discharge a waste developing agent as the second waste; and the single housing is disposed between the apparatus housing and the plurality of developer units to be connected to the first outlets and the second outlets of the respective developer units.

* * * * *